US007165869B2

(12) United States Patent
Chernick et al.

(10) Patent No.: US 7,165,869 B2
(45) Date of Patent: Jan. 23, 2007

(54) INTERNALLY ILLUMINATED ELASTOMERIC NOVELTY DEVICE WITH EXTERNAL PROJECTIONS

(76) Inventors: Mark Chernick, 19180 144th Ave., NE., Woodinville, WA (US) 98072; Webb T. Nelson, 19180 144th Ave., NE., Woodinville, WA (US) 98072

( * ) Notice: Subject to any disclaimer, the term of this patent is extended or adjusted under 35 U.S.C. 154(b) by 6 days.

(21) Appl. No.: 11/027,378

(22) Filed: Dec. 31, 2004

(65) Prior Publication Data

US 2006/0146525 A1 Jul. 6, 2006

(51) Int. Cl.
*F21V 3/00* (2006.01)
*F42B 4/16* (2006.01)
*F21L 4/00* (2006.01)

(52) U.S. Cl. ..... 362/363; 362/196; 362/198; 362/276; 362/802; 473/570; 446/485; 446/397

(58) Field of Classification Search ..... 362/196, 362/198, 276, 802, 363, 555, 800, 808; 473/545, 473/800, 570, 871; 446/485, 397
See application file for complete search history.

(56) References Cited

U.S. PATENT DOCUMENTS 2,020,484 A * 11/1935 Turner ..... 473/570
5,228,686 A * 7/1993 Maleyko ..... 473/570
5,388,825 A * 2/1995 Myers et al. ..... 473/570
5,779,574 A * 7/1998 Allman et al. ..... 473/570
6,101,636 A * 8/2000 Williams ..... 2/410
6,142,894 A * 11/2000 Lee ..... 473/570
6,428,432 B1 * 8/2002 Kachel ..... 473/570
6,464,602 B1 * 10/2002 Rottger ..... 473/571
6,530,581 B1 * 3/2003 Lai ..... 280/11.203
6,851,817 B1 * 2/2005 Wong ..... 362/35
2005/0231961 A1 * 10/2005 Mahoney ..... 362/363

* cited by examiner

*Primary Examiner*—Sandra O'Shea
*Assistant Examiner*—Jacob Y. Choi
(74) *Attorney, Agent, or Firm*—Lamorte & Associates

(57) ABSTRACT

An internally illuminated novelty device having an electronics module contained within a translucent elastic casing. The elastic casing has a hollow central region that defines an internal pocket. A plurality of protrusions extend outwardly from the central region so as to cushion the central region from experiencing any direct impact forces. The electronics module is disposed within the internal pocket so that the elastic casing surrounds the electronics module. The electronics module includes a housing, at least one light source, at least one battery, and a switch for activating and deactivating the light source. The switch is controlled by selectively compressing the housing. Since the housing is within the elastic casing, the switch can be controlled by selectively squeezing the elastic casing. When activated, the light source illuminates the interior of the elastic casing, thereby internally illuminating the novelty device.

12 Claims, 3 Drawing Sheets

INTERNALLY ILLUMINATED ELASTOMERIC NOVELTY DEVICE WITH EXTERNAL PROJECTIONS

BACKGROUND OF THE INVENTION

1. Field of the Invention

In general, the present invention relates to novelty items, such as balls and similar handheld objects, that are internally illuminated. The present invention also relates to novelty objects that are fabricated from elastomeric gel.

2. Background Art

Since the commercialization of the small alkaline battery, many electrical components have been added to toys and other novelty objects. The prior art of toys is replete with toys that contain various motors, lights and electronic sound effects. One of the simplest toys that has been electrified is the ball.

There are many balls that contain internal lights. There are internally illuminated golf balls, footballs, soccer balls and many others that are currently commercially available. However, when a traditional ball is internally illuminated, the structure of the ball must be highly modified. In order to internally illuminate a ball, the ball must be provided with an internal light source and batteries. A segment of the ball must also be made to be translucent so that the internal illumination can be seen. Furthermore, an on/off switch must be added to the ball so that the light source within the ball can be selectively activated and deactivated. The presence of on/off switches and translucent panels on a ball provides the ball with hard surfaces that can hurt a child catching such a ball. Additionally, adding all of these features to a ball often causes the ball to have an eccentric center of gravity. The illuminated ball therefore wobbles when thrown or rolled. If the ball is balanced to maintain a central center of gravity, often the ball is complex and costly to manufacture.

The present invention provides an internally illuminated novelty device that is very inexpensive to manufacture, yet provides a centralized center of gravity. The present invention also provides a novelty device that has a unique on/off mechanism and light dispersing structure that allows the entire exterior of the novelty device to be soft. This invention is described and claimed below.

SUMMARY OF THE INVENTION

The present invention is an internally illuminated novelty device. The novelty device has an elastic casing with a hollow central region that defines an internal pocket. A plurality of protrusions extend outwardly from the central region so as to cushion the central region from experiencing any direct impact forces.

An electronics module is disposed within the internal pocket so that the elastic casing surrounds the electronics module. The electronics module includes a housing, at least one light source, at least one battery, and a switch for activating and deactivating the light source. The switch is controlled by selectively compressing the housing. Since the housing is within the elastic casing, the switch can be controlled by selectively squeezing the elastic casing. When activated, the light source illuminates the interior of the elastic casing, thereby internally illuminating the novelty device.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

The present invention is an internally illuminated novelty device that can be selectively activated and deactivated. The novelty device has an exterior made of an elastomeric gel material. The exterior of the novelty device can be molded into any shape, such as that of a doll or animal. However, in its simplest form, the novelty device is formed as a ball. Accordingly, the shown exemplary embodiment of the present invention is presented as a ball having exterior projections that enhance the interior illumination to provide one of the best and simplest modes contemplated for the invention. However, it should be understood that the novelty device can function as described below if configured into alternate shapes more complex than a ball.

Figure 1:
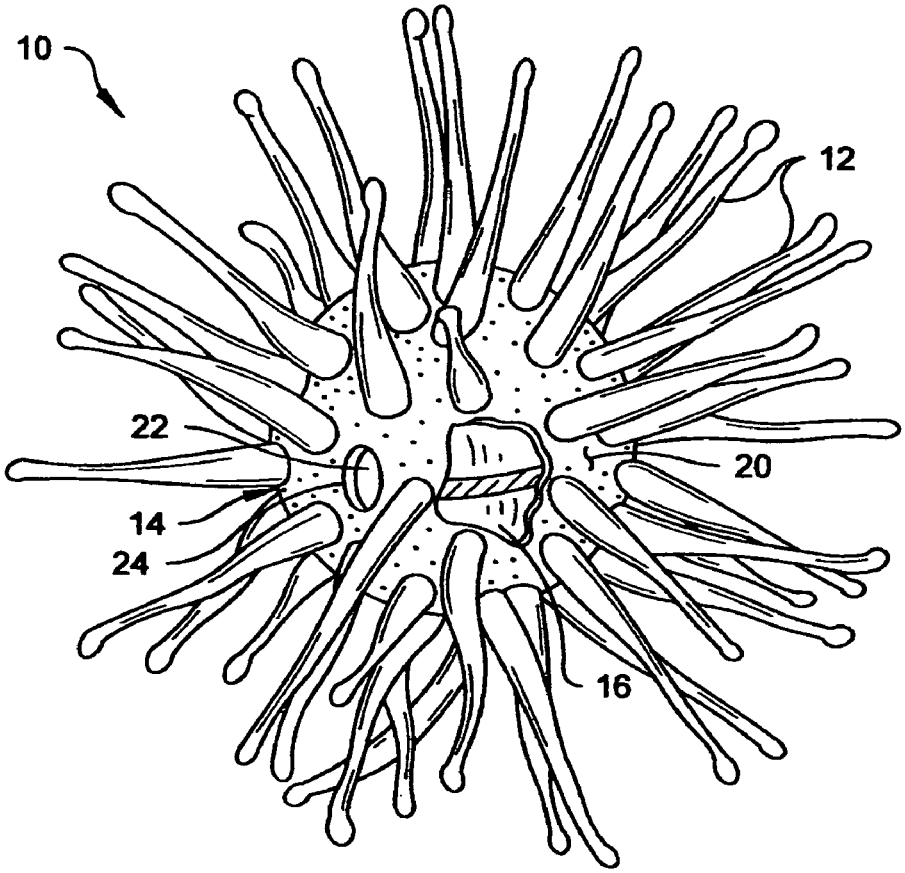
FIG. 1 is a partially fragmented perspective view of an exemplary embodiment of the present invention novelty device.

Referring to FIG. 1, the present invention novelty device 10 is embodied as a toy ball having multiple tentacle projections 12. The novelty device 10 is comprised of a molded exterior casing 14 and an internal electronics module 16 that is used to illuminate the molded exterior casing 14.

The molded exterior casing 14 is made of a triblock copolymer that is mixed with a plasticizing oil to produce an elastomeric gel. The exterior casing 14 itself is preferably formed from a poly(styrene-ethylene-ethylene-propylene-styrene) copolymer mixed between two percent and twenty percent, by weight, with a plasticizing oil, such as mineral oil. The resulting composition is both highly elastic and highly tear resistant. An oxidizing agent can also be added to the elastic polymer composition to reduce the tackiness of the elastic polymer composition. Alternate triblock copolymers mixed with plasticizing oil can also be used.

The exterior casing 14 has a spherical central region 20 that is hollow and defines an internal chamber 22. The tentacle projections 12 radially extend from the spherical central region 20 in all directions. A small opening 24 is present on the spherical central region 20 that allows for access to the internal chamber 22. The opening 24 in the spherical central region 20 can be elastically expanded to a diameter that is greater than that of the spherical central region 20 itself, without being damaged. This allows the electronics module 16 to be selectively inserted into, and removed from, the exterior casing 14 without damaging the exterior casing 14.

The tentacle projections 12 that radially extend from the spherical central region 20 are preferably molded with the spherical central region 20 and are made from the same elastomeric gel material as is the spherical central region 20. The length, diameter and number of tentacle projections 12 are a matter of design choice. However, for aesthetics, it is preferred that the tentacle projections 12 are sized so that they slightly bend under their own weight.

The tentacle projections 12 are solid and provide a cushion for the spherical central region 20. If the novelty device 10 is thrown, the spherical central region 20 will not directly impact against any surface. Rather, the elastomeric tentacle projections 12 surround and protect the spherical central region 20 and absorb most of the energy from any impact. The tentacle projections 12 also act as a wind brake, preventing the novelty device 10 from flying, when thrown, at any velocity capable of causing damage to the electronics module 16. The tentacle projections, therefore, protect the electronics module 16 within the spherical central region 20 and prevent the electronics module 16 from experiencing any direct impact forces.

The elastomeric gel material used to create the exterior casing 14 can be made clear. However, a slight addition of a colorant is preferred so that the exterior casing 14 appears to have color, yet is translucent to light.

Figure 2:
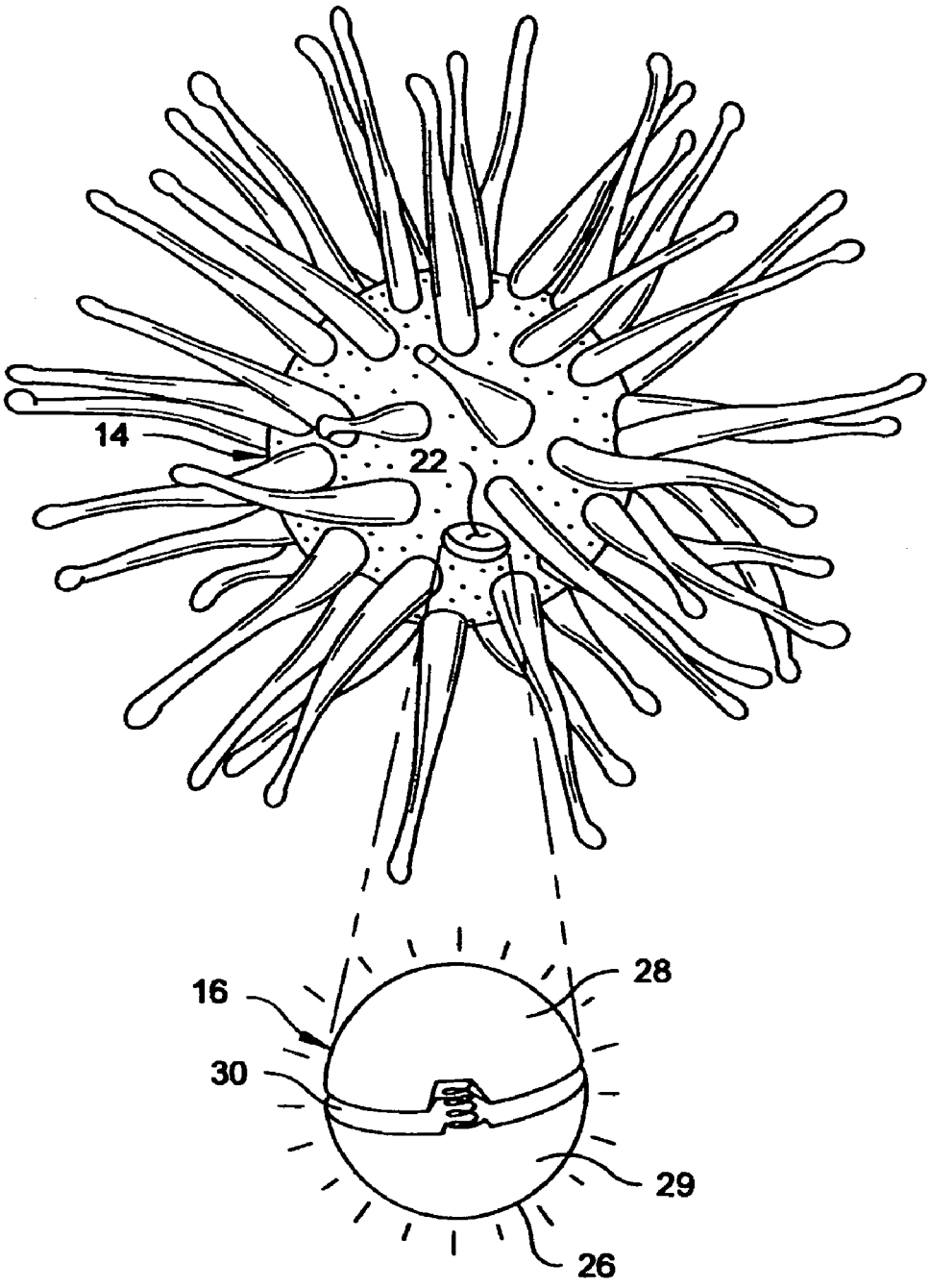
FIG. 2 is an exploded view of the embodiment of the novelty device of FIG. 1.

Referring to FIG. 2, it can be seen that the electronics module 16 that is held within the exterior casing 14 has a spherical housing 26. The spherical housing 26 is transparent or highly translucent so that light can be emitted out through the structure of the spherical housing 26. The spherical housing 26 has a diameter that is the same size, or slightly larger than the diameter of the internal chamber 22 within the exterior casing 14. In this manner, when the electronics module 16 is placed within the exterior casing 14, the spherical central region 20 of the external casing 14 stretches around the electronics module 16 and holds the electronics module 16 firmly in place.

The spherical housing 26 of the electronics module 16 is divided into two hemispherical sections 28, 29. The two hemispherical sections 28, 29 are divided by a gap space 30. The two hemispherical sections 28, 29 are biased apart. When the two hemispherical sections 28, 29 are pressed together against the bias, the operational state of the electronics module 16 is changed. That is, when the two hemispherical sections 28, 29 are pressed together, the electronics module 16 is either activated or deactivated.

Figure 3:
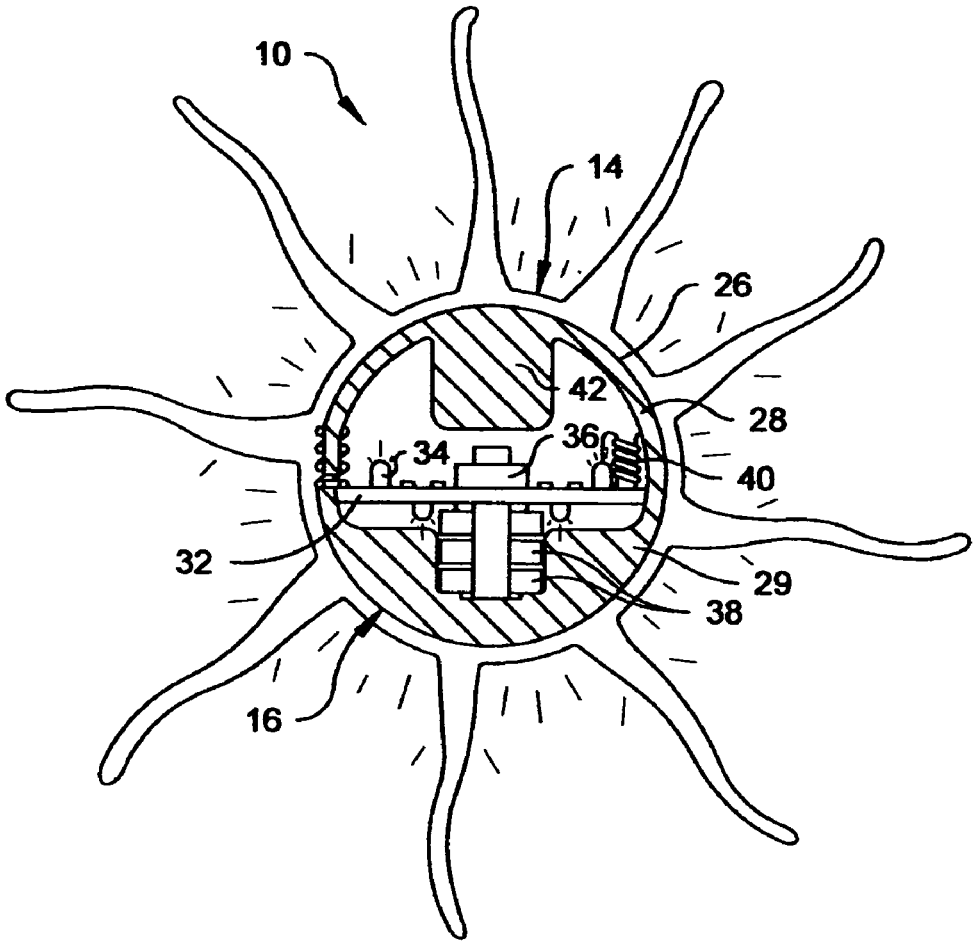
FIG. 3 is a cross-sectional view of the embodiment of the novelty device of FIG. 1.

Referring to FIG. 3, it can be seen that within the electronics module 16, there is a circuit board 32 containing at least one light emitting diode (LED) 34. An on/off switch 36 is positioned in the center of the circuit board 32. At least one disc battery 38 is disposed directly under the circuit board 32. The on/off switch 36 controls the interconnection between the LEDs 34 and the batteries 38. Thus, when the on/off switch 36 is depressed, the LEDs 34 are either activated or deactivated.

The upper hemispherical section 28 of the housing 26 and the lower hemispherical section 29 of the housing 26 are biased apart by at least one spring 40. The lower hemispherical section 29 of the housing 26 holds the circuit board 32 and the batteries 38. The upper hemispherical section 28 is shaped to support an activation finger 42 above the on/off switch 36. When the two hemispherical sections 28, 29 are held apart by the bias of the springs 40, the activation finger 42 is held above the on/off switch 36. However, when the two hemispherical sections 28, 29 of the housing 26 are pushed together with a force greater than the bias of the springs 40, then the activation finger 42 touches the on/off switch 36 and changes the state of the on/off switch 36.

The elastomeric exterior casing 14 is highly flexible. As such, a person can easily squeeze the electronics module 16 by applying a compression force to the exterior casing 14. The novelty device 10, therefore, does not have any exposed on/off switch 36. Rather, the electronics module 16 is selectively activated and deactivated by squeezing the exterior casing 14 at almost any two opposing points. As long as the squeezing force acts to bias the two hemispherical sections 28, 29 of the electronics module's housing 26 together, the electronics module 16 will either activate or deactivate.

In the embodiment of FIG. 3, the electronics module 16 is shown in an activated condition, wherein the LEDs 34 are emitting light. The light emitted by the LEDs 34 passes through the transparent spherical housing 26 and internally illuminates the exterior casing 14. The light shines through the translucent material of the spherical central region 20 of the exterior casing 14, thereby internally illuminating those surfaces. The light also travels into the tentacle projections 12, thereby internally illuminating those structures.

By placing the electronics module 16 in the center of an exterior casing 14 having multiple extending projections 12, a novelty device 10 is created that is well balanced and soft at all possible points of impact. Yet, the novelty device 10 can be manufactured very inexpensively.

It will be understood that the embodiment of the present invention novelty device that is shown is merely exemplary and that a person skilled in the art can make many variations to the embodiment without departing from the intended scope of the invention. For instance, it will be understood that the shown embodiment having tentacle projections is merely a matter of design choice. Nubs, strings, tubes and many other projection shapes can be used as part of the external casing. The appearance of the external projections is a matter of design choice. The external projections are intended to provide impact cushioning to the electronics module. All such modifications, variations and alternate embodiments are intended to be included within the scope of the present invention as defined by the claims.

What is claimed is:

1. A novelty device, comprising:

an elastic casing having a hollow central region that defines an internal area;

a plurality of protrusions extending outwardly from said central region;

an electronics module disposed within said internal area, said electronics module including a housing having two halves, at least one light source, at least one battery, at least one spring for biasing said halves of said housing apart and a switch for activating said at least one light source, wherein said switch is activated when said two halves of said housing are biased together with a force sufficient to compress said at least one spring.

2. The device according to claim 1, wherein said housing is spherical in shape.

3. The device according to claim 2, wherein said elastic casing is spherical in shape and said plurality of protrusions radially extend from said elastic casing.

4. The device according to claim 1, wherein said elastic casing defines an access hole that is smaller than said electronics module wherein said electronics module is inserted into said internal area of said elastic casing through said access hole.

5. The device according to claim 1, wherein said elastomeric casing and said plurality of protrusions are translucent to light.

6. The device according to claim 1, wherein said elastic casing and said plurality of protrusions are molded from an elastomeric gel made from a triblock copolymer mixed with a plasticizing oil.

7. The device according to claim 1, wherein said at least one light source is disposed within said housing and said housing is translucent so that light from said at least one light source passes through said housing.

8. The device according to claim 1, wherein said elastic casing has a predetermined diameter and said plurality of protrusions each have a length at least as long as said predetermined diameter.

9. An internally illuminated novelty device, comprising:

a housing having a first section and a second section;

at least one spring within said housing that biases said first section and said second section apart;

a switch disposed within said housing that is activated when said first section and said second section are biased toward one another with a force sufficient to compress said at least one spring;

a light source disposed within said housing that is selectively activated and deactivated by said switch;

a casing that surrounds said housing, wherein said casing is made from a translucent elastomeric gel.

10. The device according to claim 9, wherein said housing is spherical in shape.

11. The device according to claim 9, wherein said casing defines an internal pocket that receives said housing therein.

12. The device according to claim 9, wherein said casing includes a plurality of protrusions that radially extend outwardly.

* * * * *